United States Patent [19]

Robertson et al.

[11] Patent Number: 4,971,217

[45] Date of Patent: Nov. 20, 1990

[54] TENSIONED FLOATATION COVER WITH SLIP RING CONNECTION

[76] Inventors: William L. Robertson, 174 Oakbrier Close SW, Calgary, Alberta, Canada, T2V 5G6; Neil D. McLeod, 159 Midpark Crescent SE, Calgary, Alberta, Canada, T2X 1S7; Geoffrey C. Agassiz, 99 Massey Place, Calgary, Alberta, Canada, T2V 1G7

[21] Appl. No.: 350,948

[22] Filed: May 12, 1989

[51] Int. Cl.[5] ..... B65D 88/42; B65D 90/34; B65D 88/36

[52] U.S. Cl. ..... 220/218; 220/222; 220/227; 220/1 B

[58] Field of Search ..... 220/218, 222, 227

[56] References Cited

U.S. PATENT DOCUMENTS

| | | | |
|---|---|---|---|
| 1,580,194 | 4/1926 | Glass | 220/227 |
| 1,734,623 | 11/1929 | Griffin | 220/218 |
| 2,611,512 | 9/1952 | Fashay | 220/222 |
| 2,788,913 | 4/1957 | Allen | 220/222 |
| 2,970,716 | 2/1961 | McCammon | 220/218 |
| 2,986,302 | 5/1961 | Paulet | 220/218 |
| 3,079,030 | 2/1963 | Moyer | 220/218 |
| 3,462,040 | 8/1969 | Galloway | 220/218 |
| 3,693,825 | 9/1972 | Richman | 220/227 |
| 3,834,576 | 9/1974 | Heisterberg | 220/222 |
| 3,972,444 | 8/1976 | Adams | 220/222 |
| 3,980,199 | 9/1976 | Kays | 220/227 |
| 4,036,394 | 7/1977 | Bodley et al. | 220/222 |
| 4,199,074 | 4/1980 | Gammell et al. | 220/218 |
| 4,244,487 | 1/1981 | Kern | 220/222 |
| 4,369,044 | 1/1983 | Heisterberg | 220/222 |
| 4,438,863 | 3/1984 | Wilson et al. | 220/227 |
| 4,705,185 | 11/1987 | Barbillat | 220/227 |
| 4,710,292 | 12/1987 | DeVos | 220/227 |
| 4,723,682 | 2/1988 | Barbillat | 220/227 |

FOREIGN PATENT DOCUMENTS

| | | | |
|---|---|---|---|
| 2035852 | 1/1972 | Fed. Rep. of Germany | 220/222 |
| 2382644 | 9/1978 | France | 220/222 |

*Primary Examiner*—Stephen Marcus
*Assistant Examiner*—Stephen Castellano
*Attorney, Agent, or Firm*—William R. Hinds; George H. Dunsmuir

[57] ABSTRACT

Flotation covers for large bodies of liquid, e.g. reservoirs usually consist of large sheets or panels adapted to float on the surface of the liquid. Such covers are adapted to follow changes in liquid level. However, in general, the problem of covering the surface of the liquid around the periphery of the cover is not addressed. A solution to this problem involves a panel covering all but the peripheral edges of the liquid surface, cables connected to the edges of the panel and to counterweights for maintaining the panel centered on the surface, and floats for supporting the edges of the panel and the bottom edge of a skirt, which extends upwardly to the wall of the reservoir, the skirt being connected to the cables by slip rings, so that the skirt folds and unfolds as the liquid level rises and falls.

10 Claims, 6 Drawing Sheets

TENSIONED FLOATATION COVER WITH SLIP RING CONNECTION

BACKGROUND OF THE INVENTION

This invention relates to a cover, and in particular to a flotation cover for large liquid containers such as reservoirs.

In general, covers for large liquid containers such as reservoirs are defined by large sheets or panels of buoyant material which float on the surface of the liquid. In most cases the cover extends completely between the sides of the container, and follows changes in liquid level. Examples of floating roofs or covers are described in U.S. Pat. Nos. 3,313,443, which issued to H. S. Dial et al on Apr. 11, 1967 and 3,991,900, which issued to N. R. Burke et al on Nov. 16, 1976.

In some cases, covers of the type proposed by applicant are bulky and expensive to produce. Moreover, the covers extend between the sides of the containers such as reservoirs. A large area, heavy cover would create a considerable amount of friction with the container sides. It is readily apparent that a need still exists for a flotation cover for large liquid containers such as reservoirs.

The object of the present invention is to meet this need by providing a relatively simple flotation cover for a large liquid container which is adapted to continuously cover the entire surface of the liquid without sliding against the sides of the container.

BRIEF SUMMARY OF THE INVENTION

Accordingly, the invention relates to a flotation cover for liquid in a container comprising means forming a buoyant central membrane panel configured and dimensioned to be generally similar in plan view to the plan view of the container but smaller than the plan view of the container so as to cover a central surface area of liquid in the container inwardly of the periphery of the container, flexible skirt means extending between the periphery of said panel and the periphery of the container, means connecting one edge of the flexible skirt means to and along the periphery of said panel, means connecting the opposite edge of the skirt means to and along the upper part of the periphery of the container, said flexible skirt means being of sufficient dimension between said edges to permit said buoyant panel to move upwardly and downwardly with varying liquid levels in said container and to be not tensioned by movement of the panel to a level corresponding to a substantially empty condition of the container, a plurality of tensioned cables attached to said panel at spaced intervals near the periphery of the panel and connecting the panel to the periphery of the container for keeping the panel centralized during movement of the panel with changes in liquid level in the container, and means slidably coupling intermediate points on the skirt means between its said edges to said cables such that plural small folds are formed in the skirt means adjacent each cable rather than a single fold when said panel rises with the liquid level in the container and relative sliding movement occurs at the slidable couplings between the skirt means and the cables. In a preferred embodiment there are at least two slidable coupling points between the skirt and each of at least some of the cables.

BRIEF DESCRIPTION OF THE DRAWINGS

The invention will be described in greater detail with reference to the accompanying drawings, which illustrate a preferred embodiment of the invention, and wherein.

Figure 1:
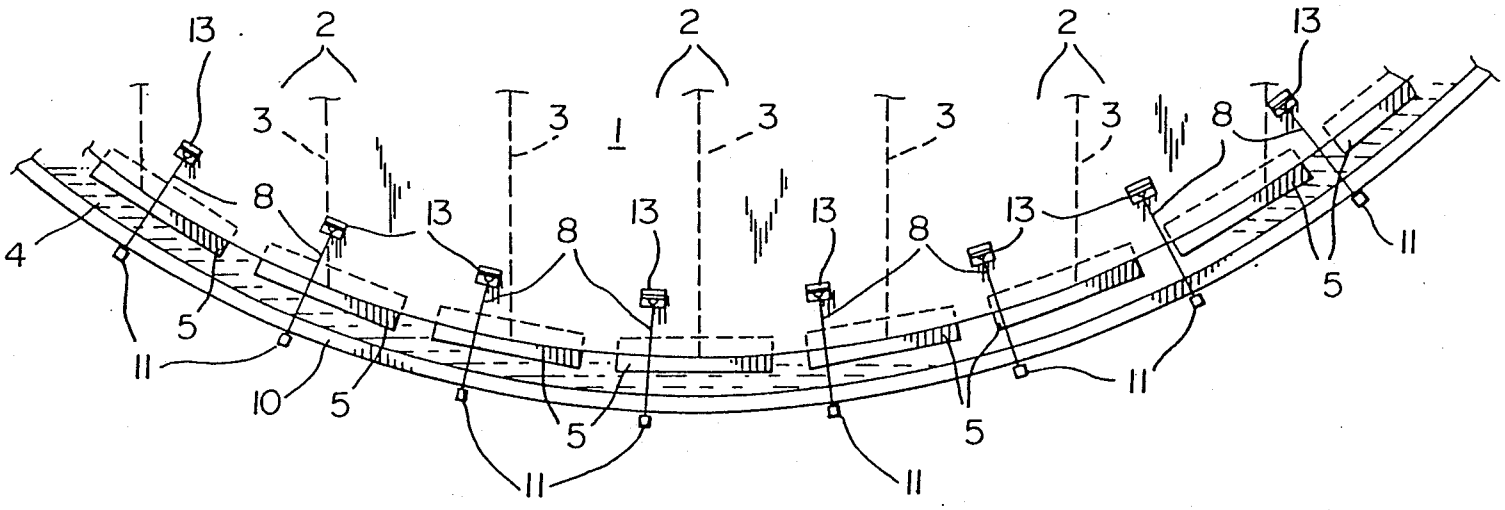
FIG. 1 is a schematic, plan view of a panel and tensioning devices used in the flotation cover of the present invention.
Figure 2:
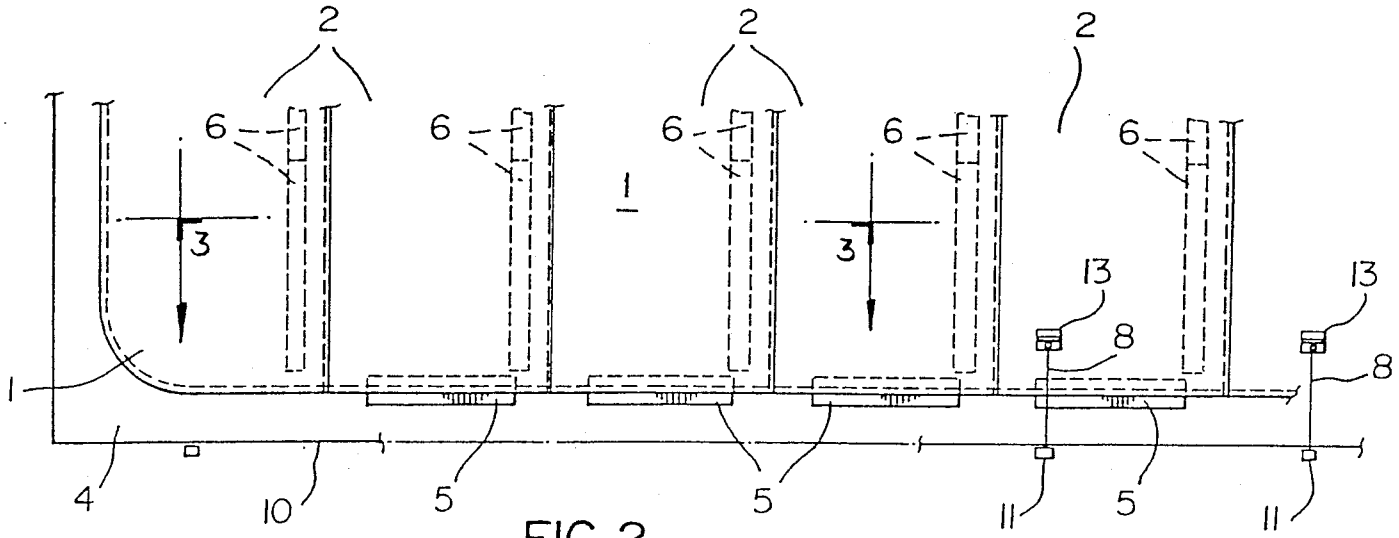
FIG. 2 is a schematic, plan view of a second form of panel used in the flotation device of the present invention.

It will be appreciated that for the sake of simplicity parts have been omitted from some of the drawings, and in particular from FIGS. 1 and 2.

DESCRIPTION OF THE DRAWINGS EMBODIMENT(S)

Figure 3:
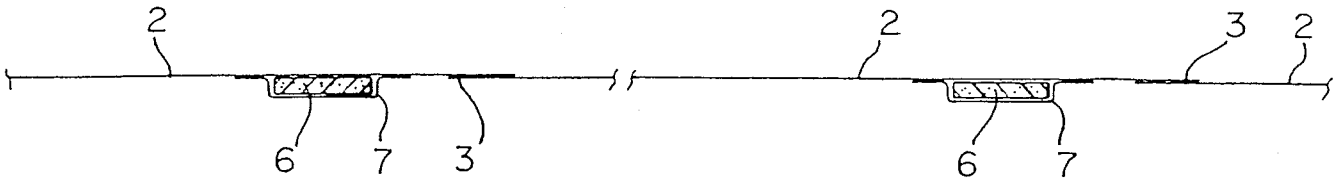
FIG. 3 is a cross section taken generally along line III—III of FIG. 2.

With reference to FIGS. 1 and 2 the cover of the present invention is intended for use on a reservoir or any other large liquid container. The reservoir can be circular (FIG. 1) or rectangular (FIG. 2). In any case, the cover includes a plastic panel 1, which is formed of elongated, polyethylene strips 2 welded together along their edges 3. The panel 1 covers all but a narrow peripheral portion 4 of the surface of the liquid. Floats 5 are attached to the periphery of the panel 1 at a plurality of spaced apart locations for rendering the edges of the panel buoyant and capable of carrying the weight of a folded sidewall. The floats 5 maintain the edges of the panel elevated, so that gases escaping from the liquid can flow from beneath the panel 1 when the liquid is sewage or another waste which releases gases. As shown in FIGS. 2 and 3, elongated cellular plastic floats 6 can be provided in downwardly extending pockets 7 to provide flow paths for gas escaping from the liquid in the reservoir.

Figure 4:
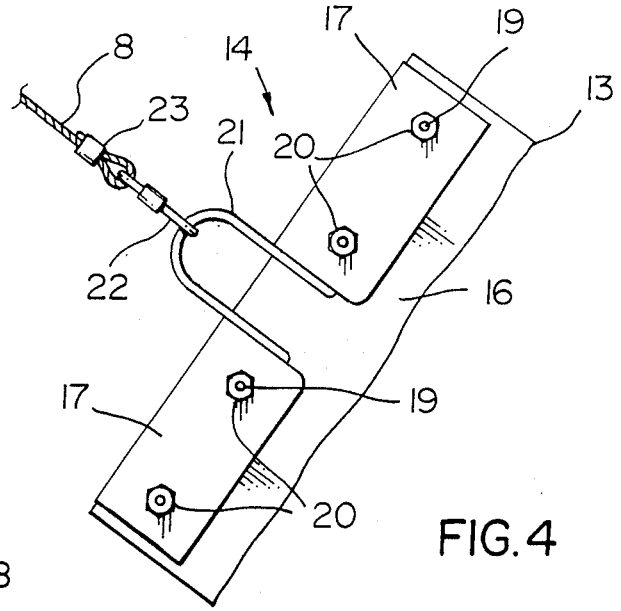
FIG. 4 is a plan view of a tab and clamp assembly used in the cover of FIGS. 1 and 2.
Figure 5:
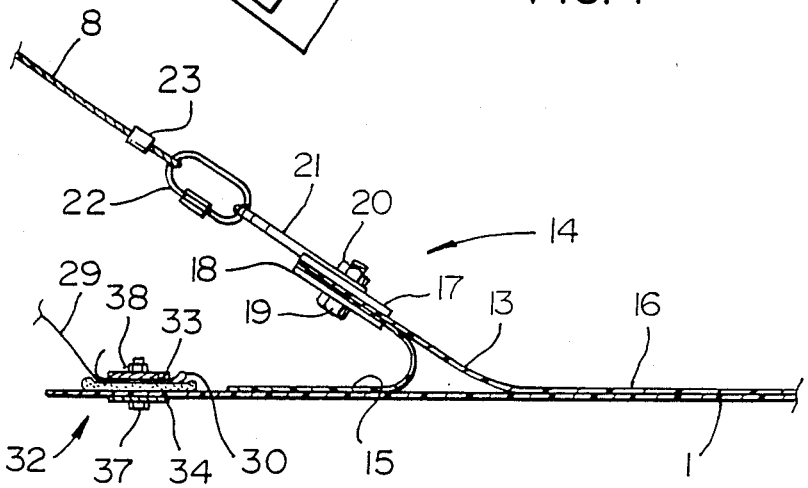
FIG. 5 is a cross section of the tab and clamp assembly of FIG. 4.
Figure 7:
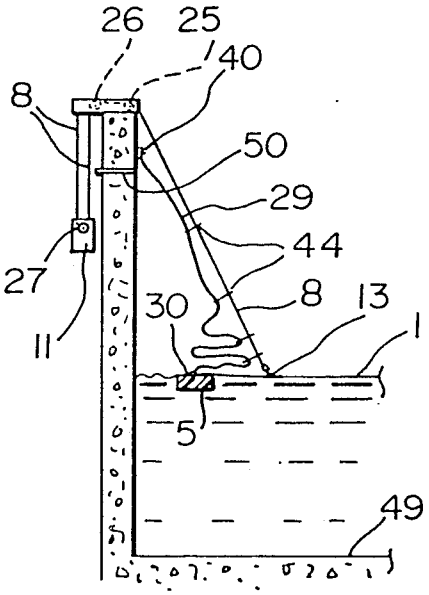
Figure 6:
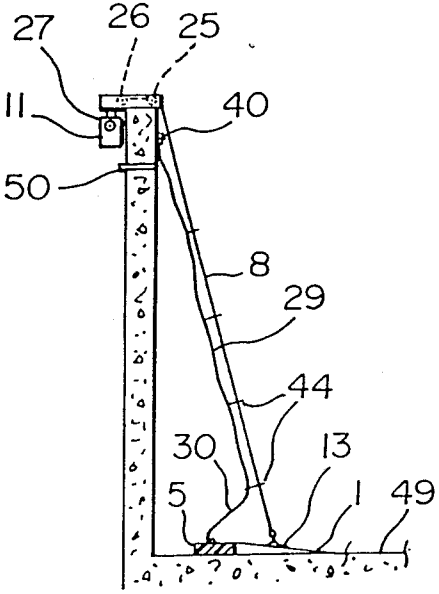

The panel 1 is maintained in the centre of the top surface of the liquid by a plurality of cables 8 spaced equidistant apart around the periphery thereof and extending over the top edge of the wall 10 of the reservoir to counterweights 11. Referring to FIGS. 4 and 5, in order to connect the cables 8 to the panel 1, flexible tabs 13 are secured to the panel 1 by adhesive or welding. A clamp assembly generally indicated at 14 is attached to the outer free ends of the two strips 15 and 16 defining the tabs 13. The clamp assembly 14 includes top and bottom metal plates 17 and 18, respectively which are connected to each other and to the tabs 13 by bolts 19 and nuts 20. An inverted U-shaped loop 21 extends outwardly from the top plates 17 to a link 22. The cable 8 extends through the link 22 and is doubled over on itself and secured together by a connector 23. The cable 8 extends from the link 22 up to pulleys 25 and 26 (FIGS. 6 to 8) on the top of the reservoir wall 10, around a pulley 27 carried by the counterweight 11 and up to a fixed point on the bracket or cap carrying the pulleys 25 and 26. Thus as the liquid level in the reservoir falls and rises (FIGS. 6 to 8), the panel 1 follows the surface of the liquid and is maintained under tension by the cables 8 and counterweights 11.

Figure 9:
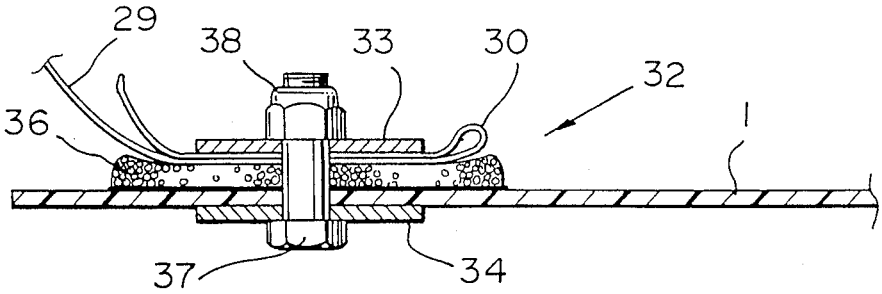
FIG. 9 is a cross-sectional view of a joint between a floating panel and a reservoir side wall.
Figure 10:
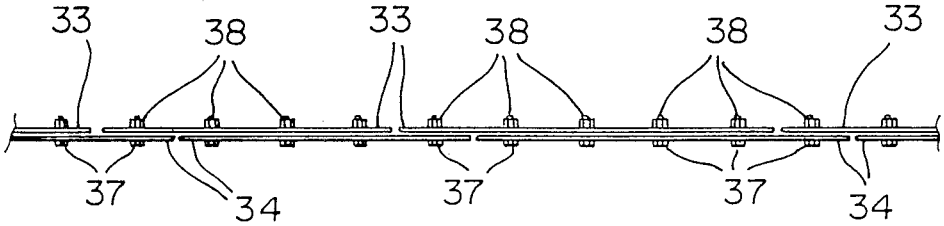
FIG. 10 is a front view of the joint of FIG. 9.

The remainder of the liquid, i.e. the peripheral portion 4 of the liquid is covered by a flexible skirt 29. The bottom edge 30 of the skirt 29 is connected to the periphery of the panel 1 by a seam structure generally indicated at 32 (FIGS. 5, 9, and 10). The seam structure 32 includes staggered top and bottom metal battens 33 and 34, i.e. battens 33 and 34, the ends of which are not aligned. The bottom edge 30 of the skirt 29 is folded over on itself and sandwiched between the top batten 33 and a sponge gasket strip 36. The battens 33 and 34 are held together by bolts 37 and nuts 38.

Figure 11:
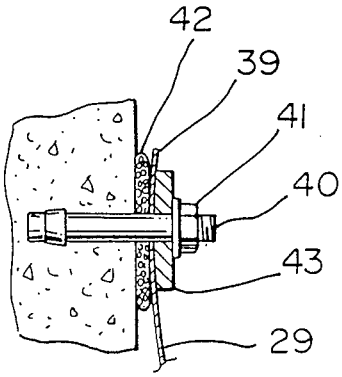
FIG. 11 is a cross section of an upper wall attachment for the skirt used in the cover of FIGS. 1 and 2.

As best shown in FIG. 11, the top edge 39 of the skirt 29 is connected continuously to the reservoir wall 10 near the top thereof by anchor bolts 40 embedded in the wall 10 and nuts 41 (one shown). The top edge 39 of the skirt 29 is sandwiched between a closed cell neoprene gasket 42 and clamp bars 43.

Figure 13:
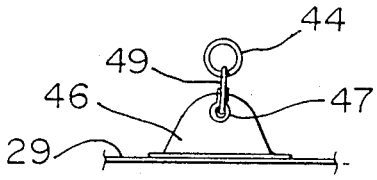
FIG. 13 is a front view of the tab of FIG. 12.
Figure 12:
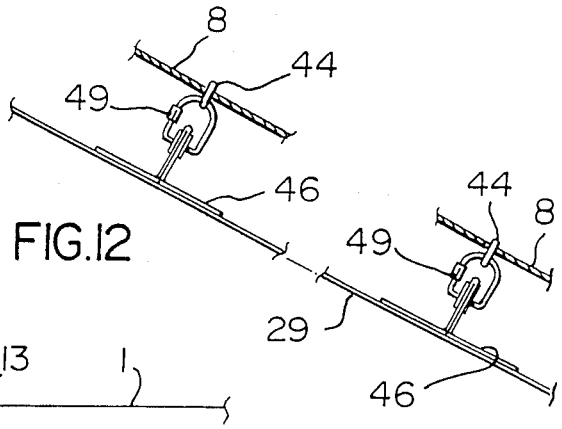
FIG. 12 is a side view of tabs used to connect a cable to the skirt used in the covers of FIGS. 1, 2 and 6 to 8.

The flexible skirt 29 is slidably attached to the cables 8 by a plurality of slip rings 44 (FIGS. 12 and 13) and tabs 46 of inverted T-shaped cross section. The tabs 46 are bonded to the skirt 29. A grommet 47 is provided in each tab 46 for receiving a link 49, which carries the ring 44.

Figure 8:
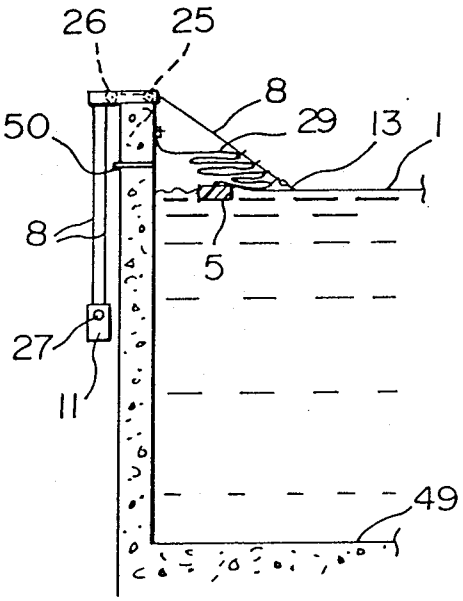
FIGS. 6 to 8 are schematic, cross-sectional views of one side of a reservoir and the cover of FIG. 1.

When the reservoir is empty (FIG. 6), the panel 1 and the floats 5 rest on the bottom 49 of the reservoir, and the skirt 29 is extended. As the liquid level in the reservoir rises (FIG. 7), the floats 5 and the panel 1 also rise, the floats 5 preventing sinking of the edge of the panel 2. As the liquid level rises the skirt 29 folds accordion style towards the bottom end of the cable 8 until the reservoir is full (FIG. 8). When the reservoir is used to store a liquid such as sewage or other waste which releases gases, the floats 5 hold the edges of the panel 1 up, facilitating the escape of gas to the area beneath the skirt 29. Outlet tubes 50 (one shown) are provided in the wall 10 of the reservoir for discharging gas therefrom.

Figure 14:
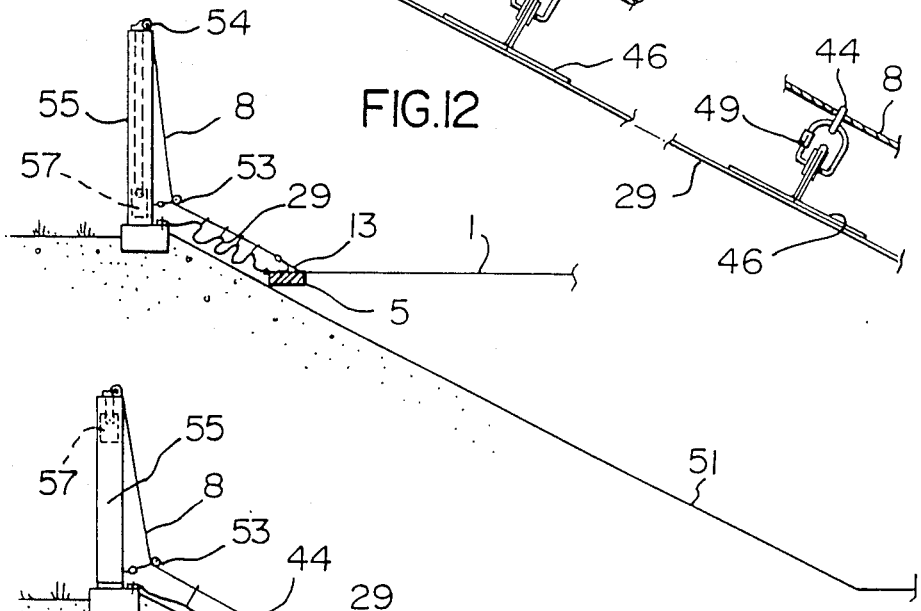
FIGS. 14 and 15 are schematic, cross-sectional views of one side of an in-ground style reservoir and a second embodiment of the cover of the present invention.
Figure 15:
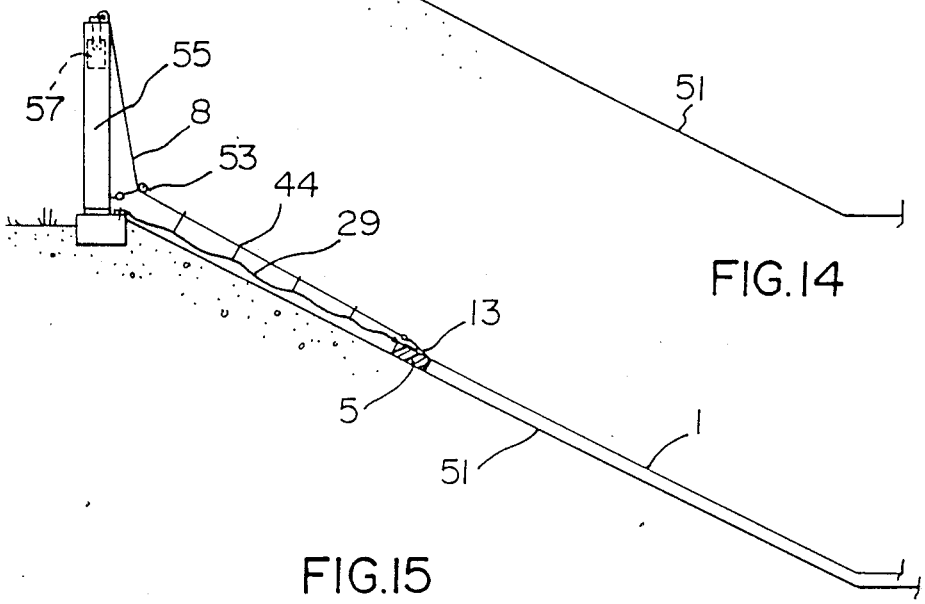

In another embodiment of the invention, (FIGS. 14 and 15), the cover is used in an in-ground reservoir with a sloping side 51. The cables 8 extend from the floats 5 beneath pulleys 53 (one shown) and around pulleys 54 on top of a tension tower 55 containing a counterweight 57.

In the preferred embodiments of the invention, the spacing between the floats 5 is approximately ten feet. It will be appreciated that the float spacing can be changed depending on the situation. Moreover, the floats can be sealed plastic pipes or bags rather than the foam plastic illustrated in the drawings. When pipe is used, a continuous pipe can extend around the entire periphery of the panel 1. The floats 5 make the panel 1 concave for directing rainwater to a central drain (not shown). As mentioned, when the cover is used on a digester or other gas producing reservoir, the floats permit gas to escape towards the sides of the reservoir where the gas can readily be removed. Of course, in some circumstances, no perimeter floats are required.

By folding the skirt 29 onto the floats 5 or the outer edge of the panel (FIGS. 6 to 8), the possibility of freezing of the folded skirt when the liquid freezes is avoided. When covering waste materials, it is essential that the skirt 29 be kept out of the liquid so that gas can readily escape to the perimeter. Moreover, the skirt 29 is kept below the top edge of the side of the reservoir or tank to reduce the likelihood of wind damage.

In operation, the cables 8 and counterweights 11 or 57 maintain the panel 1 centered in the reservoir. The skirt 29 covers the periphery of the liquid and permits free vertical movement of the panel 1 without exposing any of the surface of the liquid in the reservoir.

What we claim is:

1. A flotation cover for liquid in a container comprising means forming a buoyant central membrane panel configured and dimensioned to be generally similar in plan view to the plan view of the container but smaller than the plan view of the container so as to cover a central surface area of liquid in the container inwardly of the periphery of the container, flexible skirt means extending between the periphery of said panel and the periphery of the container, means connecting one edge of the flexible skirt means to and along the periphery of said panel, means connecting the opposite edge of the skirt means to and along the upper part of the periphery of the container, said flexible skirt means being of sufficient dimension between said edges to permit said buoyant panel to move upwardly and downwardly with varying liquid levels in said container and to be not tensioned by movement of the panel to a level corresponding to a substantially empty condition of the container, a plurality of tensioned cables attached to said panel at spaced intervals near the periphery of the panel and connecting the panel to the periphery of the container for keeping the panel centralized during movement of the panel with changes in liquid level in the container, and means slidably coupling intermediate points on the skirt means between its said edges to said cables such that plural small folds are formed in the skirt means adjacent each cable rather than a single fold when said panel rises with the liquid level in the container and relative sliding movement occurs at the slidable couplings between the skirt means and the cables.

2. A flotation cover according to claim 1, including float means for supporting said panel on the surface of the liquid.

3. A flotation cover according to claim 2, wherein said float means includes first floats for supporting the periphery of said panel to prevent sinking thereof into the liquid.

4. A flotation cover according to claim 3, wherein said float means includes second floats perpendicular to the edges of said panel above the liquid to define outwardly extending flow paths for gases escaping from the liquid.

5. A flotation cover according to claim 2, wherein said float means includes first floats for supporting the outer edges of said panel and said one edge of said skirt means to prevent sinking therof into the liquid.

6. A flotation cover according to claim 5, wherein said slidable coupling means comprise slip ring means for connecting said skirt means to said cables, whereby movement of the skirt means between the folded and unfolded positions is controlled.

7. A flotation cover according to claim 1, wherein said tensioned cables include counterweight means, and said tensioned cables extend between the periphery of said panel and the counterweight means.

8. A flotation cover according to claim 7, wherein said cables include tab means connecting ends of said cables to the periphery of said panel, and pulley means for removably mounting said counterweight means on said cables.

9. A flotation cover according to claim 3, including batten strips on the top and bottom edges of said panel in staggered relationship to each other for reinforcing said edges, said batten strips ensuring that the edges of said panel are maintained above the surface of the liquid.

10. A flotation cover as claimed in claim 1 wherein there are at least two slidable coupling points between the skirt and each of at least some of the cables.

* * * * *